US005443394A

United States Patent [19]

Billman et al.

[11] Patent Number: 5,443,394

[45] Date of Patent: Aug. 22, 1995

[54] CARD EDGE CONNECTOR HAVING POSITIVE LOCK AND EXTRACTOR

[75] Inventors: Timothy B. Billman, King; Roger L. Thrush, Clemmons, both of N.C.

[73] Assignee: The Whitaker Corporation, Wilmington, Del.

[21] Appl. No.: 237,753

[22] Filed: May 4, 1994

[51] Int. Cl.[6] ..... H01R 13/62

[52] U.S. Cl. ..... 439/157; 439/155

[58] Field of Search ..... 439/152–160, 439/372, 329, 326

[56] References Cited

U.S. PATENT DOCUMENTS

| | | | |
|---|---|---|---|
| 4,447,101 | 5/1984 | Gugliotti | 339/45 M |
| 4,469,388 | 9/1984 | Narozny | 339/45 M |
| 4,480,885 | 11/1984 | Coppelman | 339/45 M |
| 4,487,468 | 12/1984 | Fedder et al. | 339/75 MP |
| 4,531,795 | 7/1985 | Sinclair | 339/45 M |
| 4,579,408 | 4/1986 | Sasaki | 339/45 M |
| 4,640,565 | 2/1987 | Hasircoglu | 339/35 M |
| 4,781,612 | 11/1988 | Thrush | 439/328 |
| 4,874,319 | 10/1989 | Hasircoglu | 439/108 |
| 4,898,540 | 2/1990 | Saito | 439/153 |
| 4,902,239 | 2/1990 | Schindler | 439/153 |
| 4,973,270 | 11/1990 | Billman et al. | 439/630 |
| 5,074,800 | 12/1991 | Sasao et al. | 439/157 |
| 5,181,857 | 1/1993 | Layser | 439/157 |
| 5,211,568 | 5/1993 | Yamada et al. | 439/157 |
| 5,230,635 | 7/1993 | Takenouchi et al. | 439/157 |
| 5,232,374 | 8/1993 | Iino | 439/157 |

*Primary Examiner*—David L. Pirlot
*Attorney, Agent, or Firm*—Robert J. Kapalka

[57] ABSTRACT

A socket comprising a housing (10) defines an upwardly open slot (12) for receiving an edge portion of a circuit card (6). A plurality of contacts (16) extend into the slot for electrically engaging respective contact pads on the circuit card, and leads (17) of the contacts extend to an exterior of the housing for electrically engaging respective circuit traces on a substrate. A resilient beam (20) connected to the housing has a free end (24) which is normally disposed outwardly of a plane of the circuit card which is received in the slot. The free end has a projection (26) which is dimensioned for reception in an aperture (2) in the circuit card and is aligned with the aperture when the circuit card is disposed in the socket. A lock lever (50) is movable on the housing between lock and unlock positions. The lock lever has a lock arm (60) which resiliently deflects the beam when the lock lever is in the lock position, whereby the projection is moved inwardly through the plane of the circuit card and into the aperture to lock the circuit card in the socket.

20 Claims, 7 Drawing Sheets

CARD EDGE CONNECTOR HAVING POSITIVE LOCK AND EXTRACTOR

FIELD OF TEE INVENTION

The invention relates to a card edge electrical connector having a device for positively locking a circuit card in the connector and for extracting the circuit card therefrom.

BACKGROUND OF THE INVENTION

Sockets for electrically interconnecting a circuit board daughtercard to a circuit board mothercard are well-known. Such sockets include an insulative housing having an elongated slot for receiving an edge portion of the daughtercard. Contacts in the housing extend into the slot for engagement with contact pads on the daughtercard, and the contacts have leads which extend to an exterior of the housing for engagement with mating circuit traces on the mothercard.

The sockets may be either of the cam-in or direct insertion type. The cam-in type allows the daughtercard to be inserted into the slot at a first orientation with a zero insertion force. The card is then pivoted to a second orientation against spring forces exhibited by the contacts, and the card is retained in the second orientation by a latching device.

In the direct insertion type of socket, the daughtercard is inserted into the slot with a single straight line motion. There may be considerable resistance to insertion of the card due to friction forces of the contacts wiping against the card as the card is inserted into the slot. The contacts exert a normal force on the card in the slot, and these normal forces generate a frictional resistance to removal of the card from the socket. The frictional resistance contributes greatly to retaining the card in the socket and may be sufficient to retain the card in some cases. However, the cards are manufactured with a tolerance on their thickness, and a card that is near the minimum thickness will experience less frictional resistance than a card that is near the maximum thickness. Since vibration, shock and thermal stresses can cause a card to back out of its socket, additional retention mechanisms have been employed to ensure retention of the card therein.

U.S. Pat. No. 4,973,270 discloses a direct insertion type socket having card guides at each end which define grooves aligned with the card receiving slots. Opposed walls of each groove include a pair of opposed ridges which are spaced apart by a distance which is less than a minimum thickness of the card to be received therein. One of the walls is relatively thin so as to be somewhat flexible, thereby permitting the groove to be expanded upon insertion of a daughtercard to accommodate different thicknesses thereof. The ridges on the grooves provide an additional friction force which acts to retain the daughtercard in the socket. Still, the daughtercard is not held in the socket by a positive lock, and the daughtercard may shift in position, experience electrical decoupling, and become loose due to vibration, shock and thermal stresses.

U.S. Pat. No. 4,781,612 discloses a direct insertion socket having a positive lock in the form of a latch. The latch comprises a resilient arm extending from the socket body upwardly to a boss which is normally disposed in an area to be occupied by the card when the card is inserted into the socket. Insertion of the card resiliently deflects the arm until the boss becomes aligned with a hole in the card when the card is fully inserted. The resilient arm then springs back, engaging the boss in the hole and positively retaining the card in the socket. A problem with this locking device is that a tool must be used to push the boss out of the hole or to otherwise deflect the arm in order to remove the card from the socket. Modern electronic packages have components mounted in close proximity such that application of a tool may be difficult. Further, even after the boss is dislodged from the hole the card is still retained by frictional resistance of the contacts, and additional force must be applied to the card to extract the card from the socket.

There is a need for a socket having a positive locking mechanism which is simple and easy to use and does not require application of a tool. There is a further need for a socket having a positive locking mechanism combined with a card extractor mechanism.

SUMMARY OF THE INVENTION

It is an object of the invention to provide a socket having an improved circuit card retention mechanism.

It is another object of the invention to provide a socket with a mechanism to positively lock a circuit card therein.

It is a further object of the invention to provide a socket with a combination circuit card lock and extractor.

These and other objects are accomplished by a socket comprising a housing which defines an upwardly open slot for receiving an edge portion of a circuit card. A plurality of contacts extend into the slot for electrically engaging respective contact pads on the circuit card, and leads of the contacts extend to an exterior of the housing for electrically engaging respective circuit traces on a substrate. A resilient beam connected to the housing has a free end which is normally disposed outwardly of a plane of the circuit card which is received in the slot. The free end has a projection which is dimensioned for reception in an aperture in the circuit card and is aligned with the aperture when the circuit card is disposed in the socket. A lock lever is movable on the housing between lock and unlock positions. The lock lever has a lock arm which resiliently deflects the beam when the lock lever is in the lock position, whereby the projection is moved inwardly through the plane of the circuit card and into the aperture to lock the circuit card in the socket. The lock arm is withdrawn from against the beam when the lock lever is in the unlock position, whereby resiling of the beam withdraws the projection from the aperture and permits removal of the circuit card from the socket. The lock lever further includes an extractor foot which underlies the edge portion of the circuit card and moves upwardly to eject the card from the slot when the lock lever is moved from the lock to the unlock position.

BRIEF DESCRIPTION OF THE DRAWINGS

The invention will now be described by way of example with reference to the accompanying drawings in which like elements in different figures thereof are identified by the same reference numeral and wherein.

DETAILED DESCRIPTION OF THE PREFERRED EMBODIMENT

Figure 1:
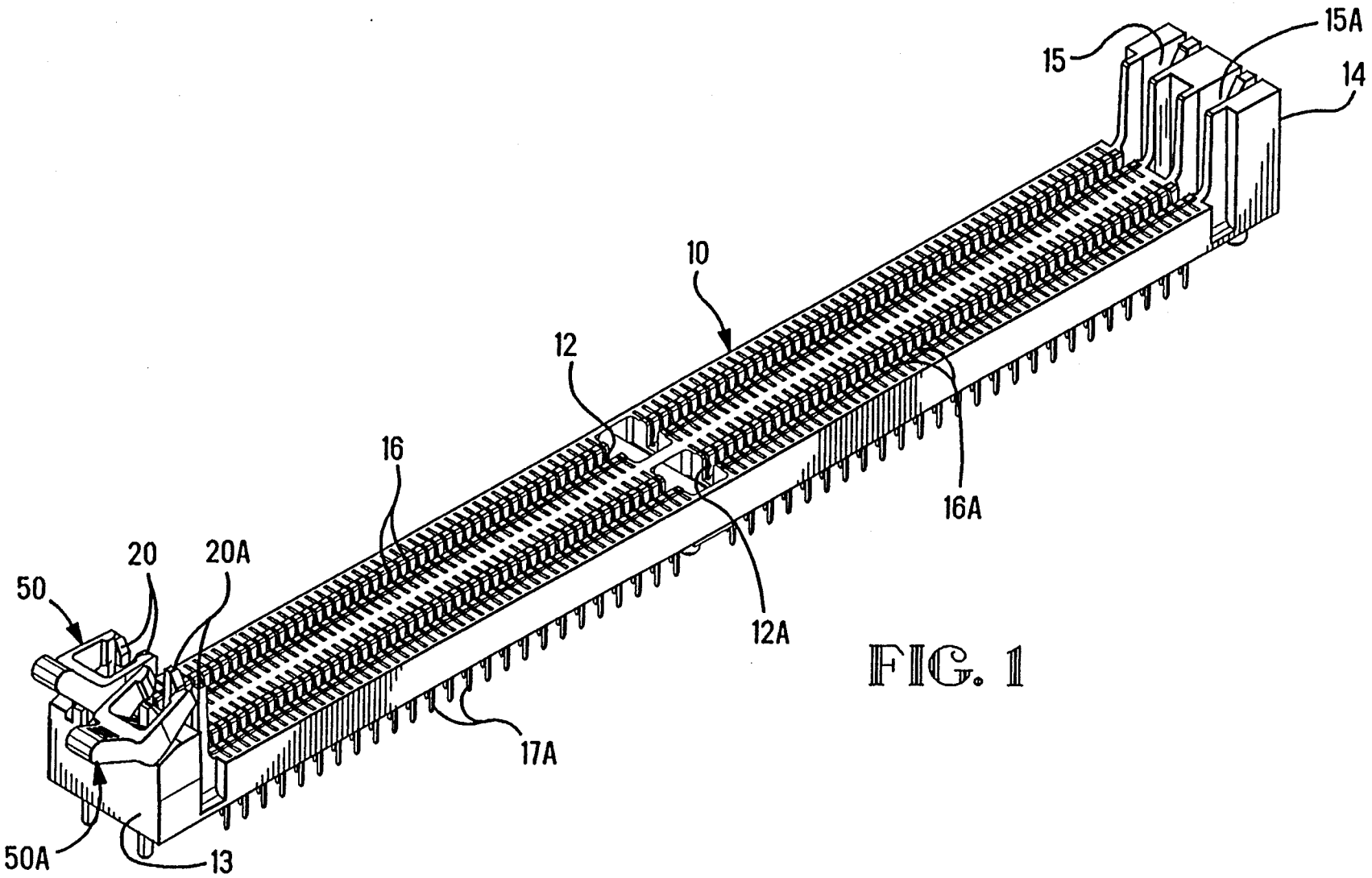
FIG. 1 is an isometric view of a socket according to the invention.

There is shown in FIG. 1 a dual row, dual in-line memory module (DIMM) socket having dual positive lock and extractor mechanisms according to the invention. The dual row DIMM socket electrically interconnects a pair of memory module daughtercards in side-by-side arrangement to a mothercard. The invention can also be incorporated in a single row DIMM or similar socket which accommodates a single daughtercard and is essentially one-half of a dual row socket, and the drawings showing a dual row socket are not intended to be limiting but merely illustrative. Illustration of the dual row DIMM socket facilitates visual comparison between lock and unlock modes of operation, and the invention was conceived with the intention of actual first use on a dual row DIMM socket. The dual row DIMM socket has pairs of like elements in side-by-side arrangement for accommodating the pair of daughtercards, and in the drawings like elements of each pair are referred to by like reference numbers with the exception that one of the pairs is distinguished by the suffix A.

Figure 2:
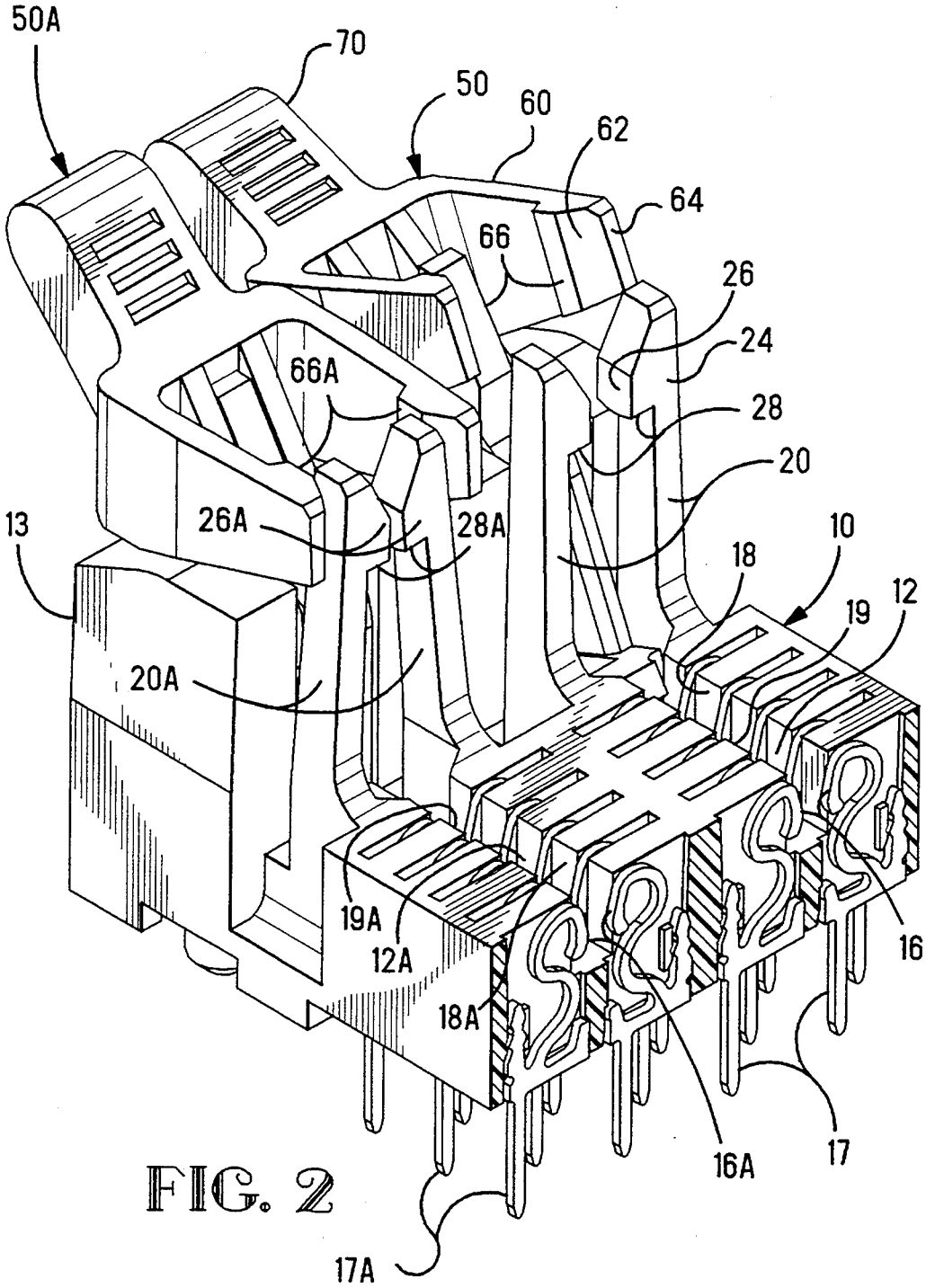
FIG. 2 is an isometric view of an end section of the socket.
Figure 3:
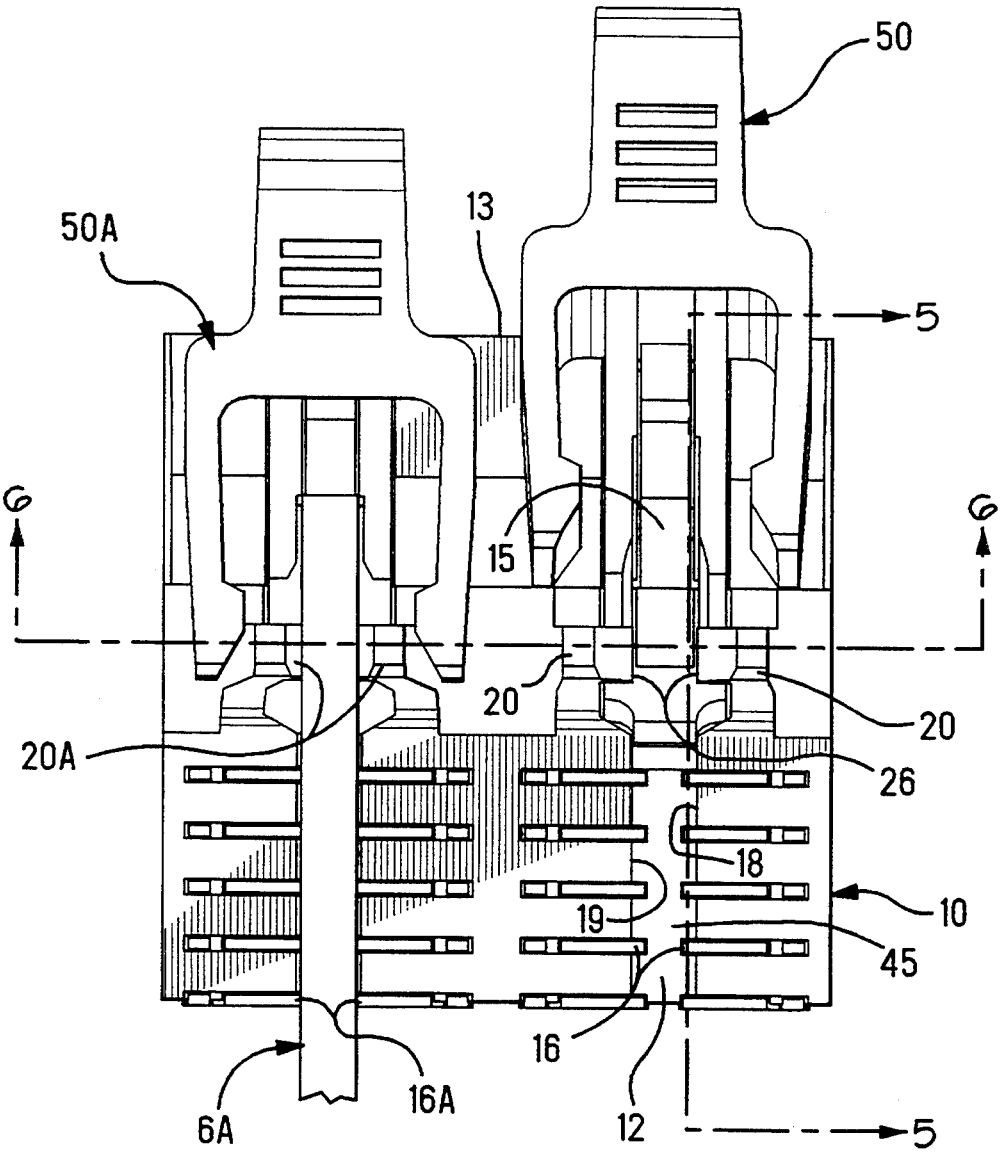
FIG. 3 is a top view of the end section shown in FIG. 2.

A socket according to the invention as shown in FIGS. 1, 2 and 3 comprises a housing 10 made from an insulative material, preferably a liquid crystal polymer. The housing 10 has a pair of slots 12, 12A which are dimensioned to receive a leading edge portion of a respective circuit panel daughtercard. The slots 12, 12A extend between opposite ends 13, 14 of the housing 10. The ends 13, 14 include grooves 15, 15A which receive side edges of the daughtercard and serve as card guides for stabilizing the daughtercard in the socket. Each of the slots 12, 12A has a pair of opposite sides 18, 19 and 18A, 19A, respectively, arranged in respective planes, and the pair of planes associated with each slot define a respective circuit card reception zone 45, 45A therebetween. A plurality of contacts 16, 16A extend into the slots 12, 12A for electrically engaging respective contact pads on the respective circuit card. The contacts 16, 16A have respective leads 17, 17A which extend to an exterior of the housing 10 for electrically engaging respective circuit traces on a mothercard substrate such as by conventional surface mount or through-hole solder techniques.

Figure 6:
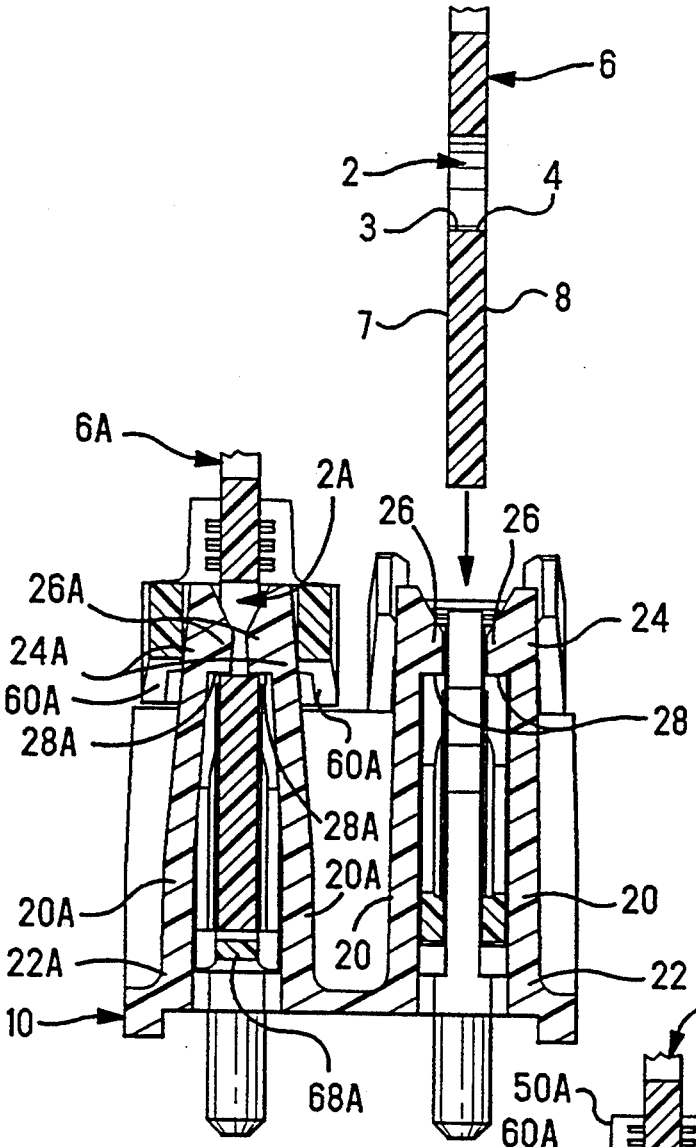
FIG. 6 is a cross-sectional view taken along line 6—6 in FIG. 3 showing a locking mechanism in locked and unlocked positions.

Referring now to FIGS. 3 and 6, a circuit card 6A is disposed in the socket and a similar circuit card 6 is disposed prior to insertion in the socket. The circuit card 6 has a pair of opposite faces 7, 8 which define a pair of opposite planes. An aperture 2 extending through the circuit card 6 provides ledges 3,4 which extend inwardly from each of the opposite planes. Although the aperture 2 is preferably a through-hole, it will be readily apparent to those skilled in the art that the ledges 3,4 may be provided by other equivalent structures, and all such equivalents are considered to be within the scope of the invention. For example, the ledges 3,4 may be provided by a pair of blind holes or dimples in the opposite faces 7, 8, and the blind holes or dimples need not be axially aligned. Further, the ledges 3,4 may be formed on lips or studs that protrude from the faces 7, 8, in which case outer edges of the lips or studs will define the relevant planes from which the ledges inwardly extend. Also, the invention may be practiced with a circuit card having a single one of the ledges 3,4.

The socket includes a respective pair of resilient latch beams 20, 20A associated with respective ones of the slots 12, 12A. The latch beams 20, 20A extend in cantilever fashion from the housing 10. One of the latch beams 20 is shown in an isometric cross-sectional view taken along line 5—5 in FIG. 3. The latch beam 20 extends from a fixed end 22 connected to the housing 10 to a free end 24. As shown in FIG. 6, when the latch beams 20 are in their normal, unbiased position, the free ends 24 are disposed outwardly of the respective planes defined by the respective proximate faces 7,8 of the circuit card 6 which is to be inserted in the socket. The free ends 24 each define a latch projection 26 which is dimensioned for reception in the aperture 2. The projections 26 are aligned with the aperture 2 when the circuit card 6 is fully inserted in the slot 12 of the socket such that inward deflection of the main beams 20 will cause the projections 26 to reside within the aperture 2 and underside or bottom surfaces 28 will be disposed above respective ones of the ledges 3, 4. The bottom surfaces 28 are preferably perpendicular to the planes defined by the faces 7, 8, and the bottom surfaces 28 have curved surface profiles which are shaped complementary to the ledges 3, 4 defined by the wall of the aperture 2. Each of the projections 26 has an upper beveled surface 30 to facilitate entry and exit of the projection 26 in and from the aperture 2.

Lock levers 50, 50A is selectively movable on the housing 10 to resiliently deflect the beams 20, 20A so as to move the projections 26, 26A to positions within the aperture 2, 2A, thereby preventing withdrawal of the circuit card from the socket. The lock levers 50, 50A are independently operable.

Figure 4:
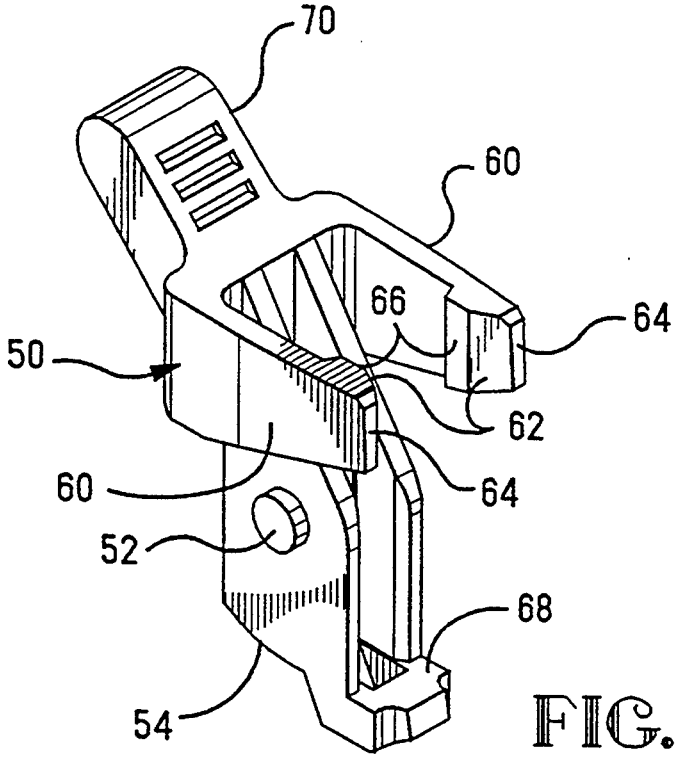
FIG. 4 is an isometric view of a lock lever used in the socket according to the invention.

In a preferred embodiment as shown in FIG. 4, the lock lever 50 has a pair of lock arms 60 each of which has a beveled surface 62 extending from a leading end 64 to a lock face 66. The lock lever 50 is pivotally mounted in the housing on an axis extending through a pair of journals 52 only one of which is visible, the other being hidden, the lock lever 50 being symmetric about a vertical plane. Undersides 54, only one of which is visible, are arcuately shaped surfaces which are coaxial with the journals 52. The lock lever 50 further includes an extractor foot 68 and an actuator handle 70.

Figure 5:
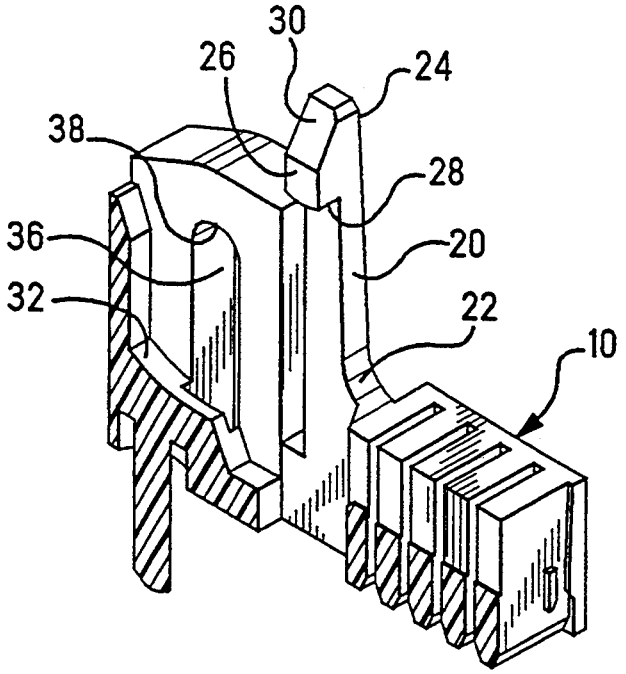
FIG. 5 is an isometric cross-sectional view taken along line 5—5 in FIG. 3.
Figure 8:
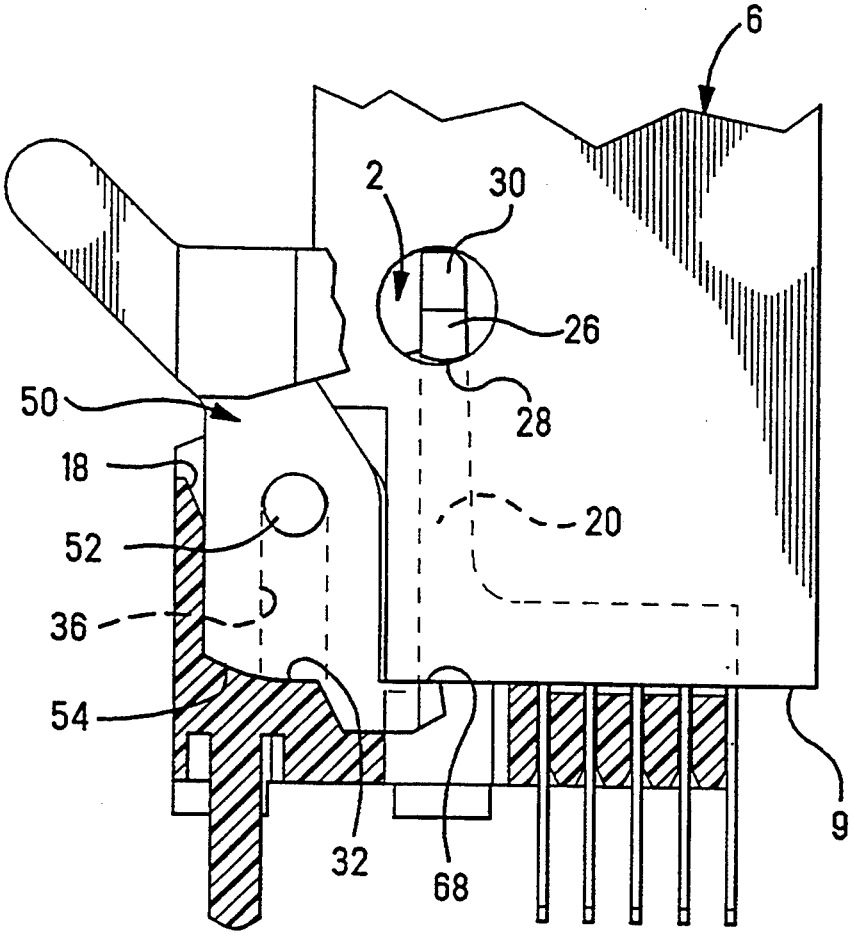
FIG. 8 is a partial cross-sectional view showing a locking mechanism in the locked position.
Figure 9:
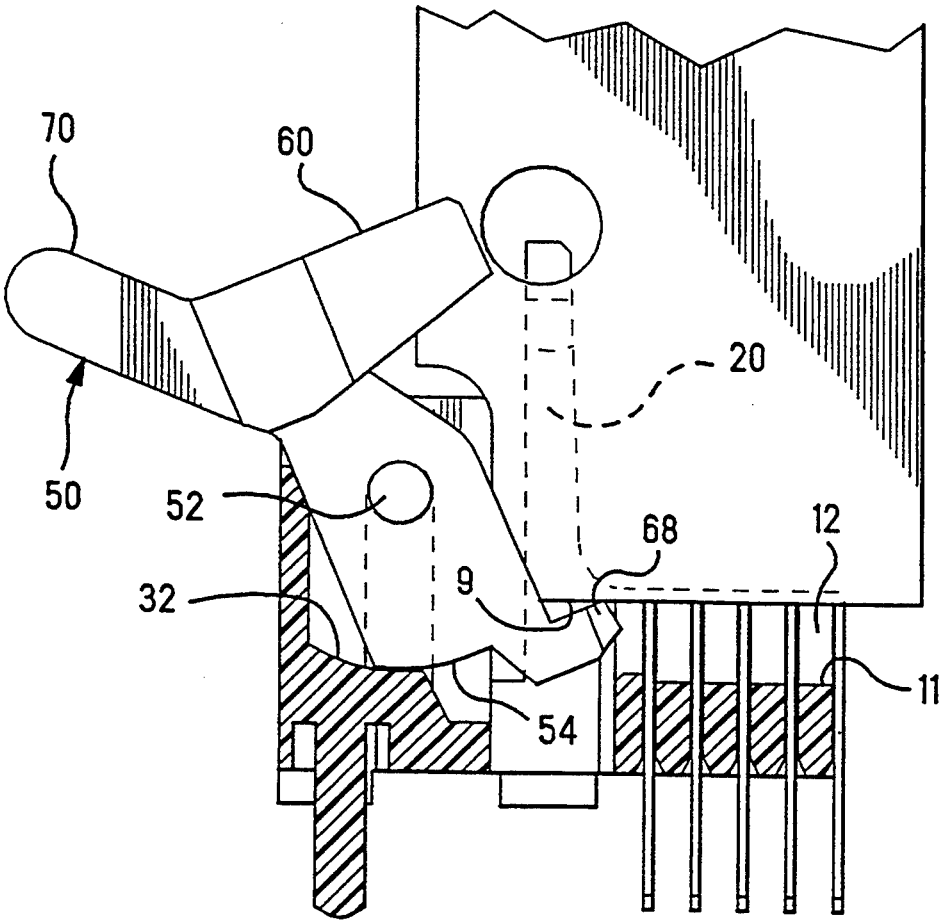
FIG. 9 is a partial cross-sectional view showing a locking mechanism in the unlocked position.

Referring to FIGS. 5, 8 and 9, the lock lever 50 is secured in the housing 10 by the journals 52 being arranged in slots 36 which have a closed top surface 38. The undersides 54 of the lock lever 50 are slidably supported on complementary shaped support surfaces 32 of the housing 10. The lock lever 50 is thus restrained in the vertical direction by the top surfaces 38 and the support surfaces 32, and is restrained in the horizontal direction by walls of the slot 36. The lock lever 50 is pivotal between a lock position as shown in FIG. 8 and an unlock position as shown in FIG. 9. In the unlock position the extractor foot 68 is raised above a bottom surface 11 of the slot 12 in order to eject the circuit card 6 from the socket. A wall 18 of the housing serves as an abutment to limit pivoting of the lock lever 50 in the unlock direction. Additional views of the lock and unlock positions are shown in FIGS. 2, 3 and 6 wherein the lock lever 50 is in an unlock position and lock lever 50A is in a lock position.

Insertion and locking of a circuit card in the socket will now be discussed with reference to FIGS. 6 and 7. The lock lever 50A is in the lock position with the circuit card 6A locked in the socket. The lock lever 50 is in the unlock position with the circuit card 6 about to be introduced into the socket. The beams 20 extend upwardly from the housing parallel to the planes defined by side faces 7, 8 of the circuit card 6. The free ends 24 including the latch projections 26 are disposed outwardly of respective ones of the planes defined by the faces 7, 8, thus permitting direct insertion of the circuit card 6 into the socket.

Figure 7:
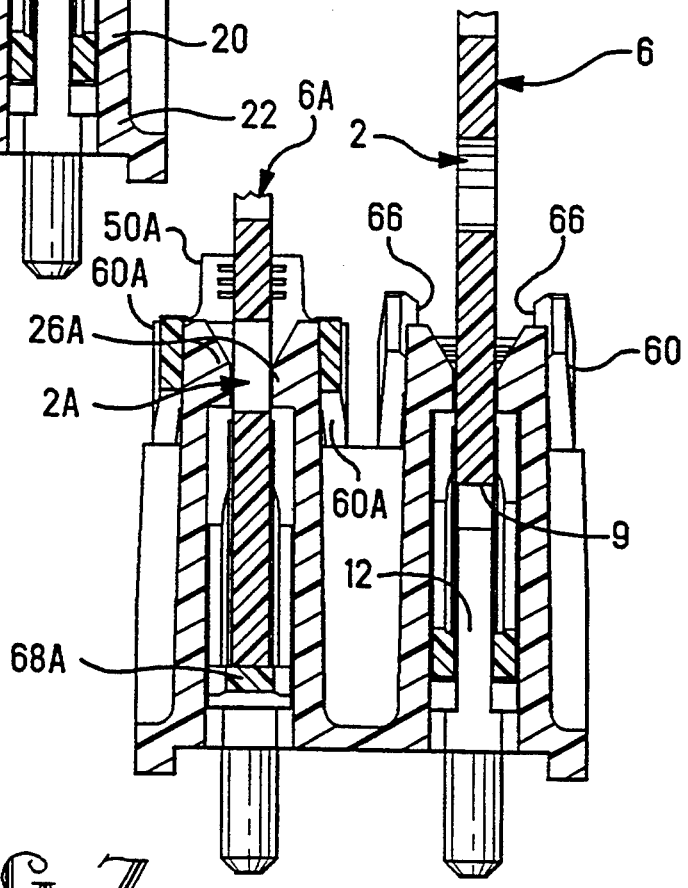
FIG. 7 is a cross-sectional view similar to FIG. 6 showing a circuit card in progressive stages of insertion in the socket.

In FIG. 7, the circuit card 6 is partially inserted into the socket, leading edge 9 of the circuit card having not yet encountered the bottom of the slot 12. The circuit card 6A is fully inserted into the socket, leading edge 9A having engaged the extractor foot 68A so as to pivot the lock lever 50A toward the lock position and bring the lock arms 60A into initial engagement with the free ends 24A of beams 20A. With the circuit card 6A fully inserted in the socket, the latch projections 26A are in alignment with the aperture 2A at opposite ends thereof. In order to lock the circuit card in the socket, the lock lever 50A is manually pivoted to the lock position shown in FIGS. 3 and 6. As can be seen, the lock arms 60A engage the pair of beams 20A from opposite sides and resiliently deflect the beams 20A, thereby narrowing a gap between the free ends 24A and moving the projections 26A through the planes defined by the side faces of the circuit card and into the aperture 2A. With the lever 50A in the lock position, withdrawal of the circuit card 6A from the socket is firmly resisted by engagement of the wall of the aperture 2A against the bottom surfaces 28A of the projections 26A, thereby preventing inadvertent backing out of the circuit card such as could be caused by vibration, shock or thermal stress.

When the lock lever 50A is moved to the unlock position, the beams 20A are permitted to resile to their normal, unstressed positions represented by the beams 20. Resiling of the beams moves the projections 26, 26A clear of the ledges 3,4, thereby permitting the circuit card to be removed from the socket upon application of a force sufficient to overcome the retention force resulting from friction of the contacts 16, 16A against the circuit card.

The extractor foot 68 on the lock lever 50 enables a lifting force to be applied to the circuit card as the lock lever 50 is being moved to the unlock position. The extractor foot 68 underlies the leading edge 9 of the circuit card and is raised upwardly as the lock lever is pivoted from the position shown in FIG. 8 to the position shown in FIG. 9. Upward pivoting of the extractor foot 68 is sufficient to lift the leading edge 9 out of the slot 12 against frictional resistance of the contacts 16, whereupon the circuit card is readily removed by hand.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

We claim:

1. A socket for electrically connecting a circuit card to a substrate, comprising:

a housing which defines an upwardly open slot for receiving an edge portion of the circuit card, the slot having a pair of opposite sides arranged in respective planes which define a card reception zone therebetween;

a plurality of contacts extending into the slot for electrically engaging respective contact pads on the circuit card, leads of the contacts extending to an exterior of the housing for electrically engaging respective circuit traces on the substrate;

a resilient beam connected to the housing and having a free end with a projection which is normally disposed outwardly of the card reception zone; and, a lock lever movable on the housing between a lock position wherein the beam is deflected and the projection is moved into the card reception zone to a position above a ledge of the circuit card which is received in the slot, thereby preventing removal of the circuit card from the socket, and an unlock position wherein the beam resiles and the projection moves outwardly of the card reception zone to a position not above the ledge, thereby permitting removal of the circuit card from the socket.

2. The socket according to claim 1, wherein the beam extends upwardly from the housing and parallel to a plane of the circuit card.

3. The socket according to claim 1, further comprising an extractor connected to urge the circuit card out of the slot when the lock lever is moved to the unlock position.

4. The socket according to claim 3, wherein a pivot axis of the lock lever extends perpendicular to a plane of the circuit card.

5. The socket according to claim 3, wherein the lock lever is pivotal on the housing.

6. The socket according to claim 5, wherein the extractor is integral with the lock lever.

7. The socket according to claim 6, wherein the extractor underlies the edge portion of the circuit card.

8. A socket for electrically connecting a circuit card to a substrate, the circuit card having a face which defines a plane and an aperture extending inwardly from the plane, the socket comprising:

a housing which defines an upwardly open slot for receiving an edge portion of the circuit card;

a plurality of contacts extending into the slot for electrically engaging respective contact pads on the circuit card, leads of the contacts extending to an exterior of the housing for electrically engaging respective circuit traces on the substrate;

a resilient beam connected to the housing and having a free end which is normally disposed outwardly of the plane when the circuit card is disposed in the socket, the free end having a projection which is dimensioned for reception in the aperture and is aligned with the aperture when the circuit card is disposed in the socket; and, a lock lever movable on the housing between lock and unlock positions,.the lock lever having a lock arm which resiliently deflects the beam when the lock lever is in the lock position, whereby the projection is moved inwardly through the plane of the circuit card and into the aperture to lock the circuit card in the socket, the lock arm being withdrawn from against the beam when the lock lever is in the unlock position, whereby resiling of the beam withdraws the projection from the aperture and permits removal of the circuit card from the socket.

9. The socket according to claim 8, wherein the beam extends upwardly from the housing and parallel to the plane of the circuit card.

10. The socket according to claim 8, further comprising an extractor connected to urge the circuit card out of the slot when the lock lever is moved to the unlock position.

11. The socket according to claim 9, wherein the lock lever is pivotal on the housing.

12. The socket according to claim 11, wherein the extractor is integral with the lock lever.

13. The socket according to claim 12, wherein the extractor underlies the edge portion of the circuit card.

14. The socket according to claim 8, wherein a bottom surface of the projection is perpendicular to the plane of the circuit card.

15. The socket according to claim 14, wherein a top surface of the projection is beveled with respect to the plane of the circuit card.

16. A socket for electrically connecting a circuit card to a substrate, the circuit card having a pair of opposite faces which define a pair of opposite planes and an aperture extending inwardly from each of the opposite planes, the socket comprising:

a housing which defines an upwardly open slot for receiving an edge portion of the circuit card;

a plurality of contacts extending into the slot for electrically engaging respective contact pads on the circuit card, leads of the contacts extending to an exterior of the housing for electrically engaging respective circuit traces on the substrate;

a pair of resilient beams connected to the housing, each of the beams having a free end which is normally disposed outwardly of a respective one of the opposite planes when the circuit card is disposed in the socket, each of the free ends having a projection which is dimensioned for reception in a respective one of the apertures and is aligned with its respective one aperture when the circuit card is disposed in the socket; and, a lock lever movable on the housing between lock and unlock positions, the lock lever having a pair of lock arms which resiliently deflect the pair of beams to narrow a gap between the free ends when the lock lever is in the lock position, whereby the projections are moved into their respective apertures to lock the circuit card in the socket, the lock arms being withdrawn from against the beams when the lock lever is in the unlock position, whereby resiling of the beams withdraws the projections from their respective apertures and permits removal of the circuit card from the socket.

17. The socket according to claim 16, wherein the beams extend upwardly from the housing and parallel to the planes of the circuit card.

18. The socket according to claim 16, further comprising an extractor connected to urge the circuit card out of the slot when the lock lever is moved to the unlock position.

19. The socket according to claim 18, wherein the lock lever is pivotal on the housing.

20. The socket according to claim 19, wherein the extractor underlies the edge portion of the circuit card.

* * * * *